US007127989B2

(12) United States Patent
Schaffrath et al.

(10) Patent No.: US 7,127,989 B2
(45) Date of Patent: Oct. 31, 2006

(54) PRINTING MATERIAL PROCESSING MACHINE, IN PARTICULAR PRINTING PRESS

(75) Inventors: Dieter Schaffrath, Lorsch (DE); Frank Kropp, Mauer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 295 days.

(21) Appl. No.: 10/813,545

(22) Filed: Mar. 29, 2004

(65) Prior Publication Data

US 2004/0189747 A1 Sep. 30, 2004

(30) Foreign Application Priority Data

Mar. 27, 2003 (DE) ..... 103 13 720

(51) Int. Cl.
*B41F 13/08* (2006.01)
*B41F 7/26* (2006.01)

(52) U.S. Cl. ..... 101/147; 101/148; 101/479; 101/480

(58) Field of Classification Search ..... None
See application file for complete search history.

(56) References Cited

U.S. PATENT DOCUMENTS 3,110,253 A 11/1963 Du Bois ..... 101/348
4,428,290 A 1/1984 Junghans et al. ..... 101/348
4,869,167 A * 9/1989 Villarreal ..... 101/348
5,119,726 A 6/1992 Dorsam ..... 101/348
6,595,133 B1 * 7/2003 Koniger ..... 101/350.3

FOREIGN PATENT DOCUMENTS

DE 80 15 906 U1 6/1980
DE 101 18 132 A1 10/2002
EP 0 668 163 B1 8/1995

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A printing material processing machine has an oscillating roll with a roll shaft, a roll barrel rotatably and translatorily mounted on the roll shaft, and an oscillating mechanism for moving the roll barrel to and fro along the roll shaft. The oscillating roll is mountable on a roll lock. A fixing device is provided and constructed in such a way that, in a dismantled state of the oscillating roll, in which the latter is released from the roll lock, the fixing device secures the roll barrel against displacement along the roll shaft and, in an installed state of the oscillating roll, in which the latter is mounted in the roll lock, permits the axial to and fro movement of the roll barrel.

15 Claims, 5 Drawing Sheets

PRINTING MATERIAL PROCESSING MACHINE, IN PARTICULAR PRINTING PRESS

BACKGROUND OF THE INVENTION

Field of the Invention

The present invention relates to a printing material processing machine, in particular a printing press. The machine has an oscillating roll which comprises a roll shaft, a roll barrel mounted on the roll shaft such that it can rotate and can be displaced axially, and an oscillating mechanism for moving the roll barrel to and fro along the roll shaft, and having at least one roll lock for mounting the oscillating roll.

In printing presses, oscillating rolls are used to distribute the printing ink axially and, in the case of lithographic printing, to distribute the damping solution axially as well. In some of these distributor rolls, as they are known, the oscillating mechanism is integrated into the interior of the roll in order to make dismantling easier, that is to say removal of the entire distributor roll including its roll barrel, its roll shaft and its oscillating mechanism from the press. This dismantling can be necessary to create improved access to another roll hidden by the distributor roll when the latter is installed, that is to say in its operating position, for the purpose of its maintenance that is carried out in the interior of the press, or in order to be able to maintain the removed distributor roll itself outside the press.

The just-mentioned arrangement of the oscillating mechanism within the distributor roll necessitates a high degree of compactness of the oscillating mechanism and an appropriately fine construction of the individual parts of the oscillating mechanism. Since these individual mechanism parts are very fine, they are necessarily also very susceptible to impact. Impacts caused by inattention during the handling of the distributor roll on its roll shaft can lead to damage to the oscillating mechanism with, in the case of two individual mechanism parts which are in contact or engagement with each other and of which one is fixed to the roll shaft and the other to the roll barrel, the impacts being transmitted from the first-named to the last-named individual mechanism part. For example, it is to be feared that, as a result of the impacts, a gearing or toothing system of the oscillating mechanism will suddenly break off or a pin in the oscillating mechanism will distort over the course of time. Experience shows that the inattention on the part of the operating or maintenance personnel, which is the cause of the impacts, can never entirely be avoided in practice. The distributor rolls are particularly at risk of impact during the removal and installation of the roll from and into the press, the unpacking and packing of the corresponding distributor roll from or in a transport case, placing the distributor roll on a workbench and, to an extremely great extent, during the alignment of the distributor roll in a vertical position of the roll shaft.

German Utility Model (Gebrauchsmuster) DE 80 15 906 U1 describes a printing material processing machine that corresponds to the generic type mentioned at the outset above—here also specifically a press. The just-explained problems exist in its oscillating roll.

European patent EP 0 668 163 B1, in which a printing material processing machine corresponding to the generic type mentioned at the beginning is likewise described, is not able to provide a solution to the afore-mentioned problem. Although a fixing device is assigned to the oscillating roll contained in the last-named patent specification, the fixing device is merely used to switch the axial oscillating movement on and off as required. The oscillating movement can be switched off by means of the fixing device during machine running. This oscillating roll is therefore suitable for a first print operating mode which requires both rotation and oscillating movement of the oscillating roll and is suitable to the same extent for a second print operating mode which requires only rotation of the oscillating roll and no oscillating movement.

SUMMARY OF THE INVENTION

It is accordingly an object of the invention to provide a printing material processing machine, and in particular a printing machine, which overcomes the above-mentioned disadvantages of the heretofore-known devices and methods of this general type and which printing material processing machine has an oscillating roll that can be handled without danger relating to damage to its oscillating mechanism.

With the foregoing and other objects in view there is provided, in accordance with the invention and in combination with a printing material processing machine, an oscillating roll assembly, comprising:

an oscillating roll having a roll shaft, a roll barrel rotatably and axially displaceably mounted on the roll shaft, and an oscillating mechanism for moving the roll barrel to and fro along the roll shaft;

at least one roll lock for mounting the oscillating roll in the machine; and a fixing device configured to secure the roll barrel against displacement along the roll shaft in a dismantled state of the oscillating roll, in which the oscillating roll is released from the roll lock, and to permit axial displacement of the roll barrel in an installed state of the oscillating roll, in which the oscillating roll is mounted in the roll lock.

In other words, the objects are achieved by a printing material processing machine corresponding to the generic type mentioned at the beginning and having the foregoing features. That is, the oscillating roll comprises a fixing device which is constructed in such a way that, in a dismantled state of the oscillating roll, in which the latter is released from the roll lock, the fixing device secures the roll barrel against displacement along the roll shaft and, in an installed state of the oscillating roll, in which the latter is mounted in the roll lock, permits the axial to and fro movement of the roll barrel.

According to the invention, the roll barrel is fixed axially and possibly additionally also in the rotational direction with respect to the roll shaft in any case by means of the fixing device in that time interval during which the roll lock is open and the oscillating roll is either lying loosely in the roll lock or is (still or already) located outside the roll lock. The oscillating mechanism of the oscillating roll which has been dismantled and, for example, removed from the printing material processing machine is therefore secured against overload and impact and thus protected against damage. If, as a result of inattention, an axial impact is exerted on the roll shaft, then the force flow resulting from this impact will be carried via the fixing device and thus past the oscillating mechanism to the roll barrel. By contrast, if, on the other hand, an axial impact is exerted on the roll barrel, then the force flow resulting from this impact will be conducted via the fixing device and thus around the oscillating mechanism to the roll shaft. In both cases, the impact or force flow can no longer have a destructive effect on the mechanism elements or individual parts of the oscillating mechanism, which is bypassed by the force flow. The fixing device can be formed as a clamping device fixing by means of a frictional connection (inhibitor or locking brake), by means of which the roll barrel is firmly clamped to the roll shaft when dismantled, and/or as a locking device (inhibitor or locking device) fixing by means of a form fit.

In accordance with a further development, provision can be made, for example, for the fixing device to be mechanically coupled, e.g., in a geared manner, to the roll lock in such a way that, as a result of any dismantling of the oscillating roll, the fixing device is activated automatically and thus the roll barrel is fixed, and/or for the fixing device to be coupled in a geared manner to the roll lock in such a way that, as a result of any installation of the oscillating roll, the fixing device is automatically deactivated and thus the roll barrel is released. For example, a switching element for activating and deactivating the fixing device can be arranged on the roll shaft such that it can move and in such a way that the switching element can be actuated by the roll lock. As a result of these developments, high operating reliability and a high level of convenience for the operator are ensured. The protective action begins automatically or positively as the roll is removed and/or is automatically or positively canceled again as the roll is installed. The potential is thus ruled out in which human failure (forgetting to carry out specific required operations on the fixing device) entails danger to the oscillating roll.

According to a further development, the fixing device is of the drum brake type. This design of the fixing device is advantageous from various points of view: the fixing or braking force achieved is comparatively high, so that even a heavyweight roll barrel can be fixed securely by means of the fixing device designed in this way. The braking surfaces inherent to the drum brake type can also be matched without difficulty to problematic ambient conditions such as, for example, the presence of lubricant (for example oil or grease used for the lubrication of the oscillating mechanism) by means of choosing suitable brake linings and similar constructional measures. In addition, the drum brake type ensures an adequate rapidity of reaction of the fixing device when it is activated and deactivated.

In a development which is likewise advantageous with regard to easy operation, the fixing device is a latching device which can be activated in any desired axial position of the roll barrel relative to the roll shaft and is thus continuous in terms of its active principle. If such a continuous latching device is used, the operator, before dismantling the oscillating roll, does not need to take note of whether the roll barrel is located in a specific preferred position (for example left-hand or right-hand dead-point position or what is known as a central position), nor need to adjust the roll barrel in advance into such a preferred position in order to permit the roll barrel to be fixed to the roll shaft at all.

In a development which is advantageous with regard to an inexpensive drive concept, the roll barrel is driven in rotation exclusively via circumferential surface friction, that is to say via the friction which, in the installed state and with the printing material processing machine running, is exerted on the circumferential surface of the roll barrel by a cylinder rolling on the roll barrel or a roll rolling on the roll barrel.

According to developments which save installation space, provision can be made for the oscillating mechanism to be integrated into the roll barrel, at least partly and preferably for the major part or completely, and/or for the fixing device to be integrated in the roll barrel, at least partly and preferably for the major part or completely.

With regard to the distribution of a printing ink and/or a damping solution by means of the oscillating roll, which in this case is used as what is known as a distributor roll, developments according to which the oscillating roll is a damping solution or ink distributor and/or a roll that is different from an applicator roll are advantageous.

The printing material processing machine is preferably a press, for example an offset press. Instead, the printing material processing machine could also be a printing material further processing machine (post-press processing; finishing).

If the roll lock is the sole roll lock provided for mounting the oscillating roll, the oscillating roll is what is known as a cantilever-mounted roll which, in its installed state, has a shaft end mounted in the roll lock and an opposite, so-called free (unmounted) shaft end. The printing material processing machine preferably comprises a further roll lock in addition to the roll lock, so that each of the two shaft ends of the oscillating roll can be mounted in a roll lock in each case.

Other features which are considered as characteristic for the invention are set forth in the appended claims.

Although the invention is illustrated and described herein as embodied in a printing material processing machine, in particular a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
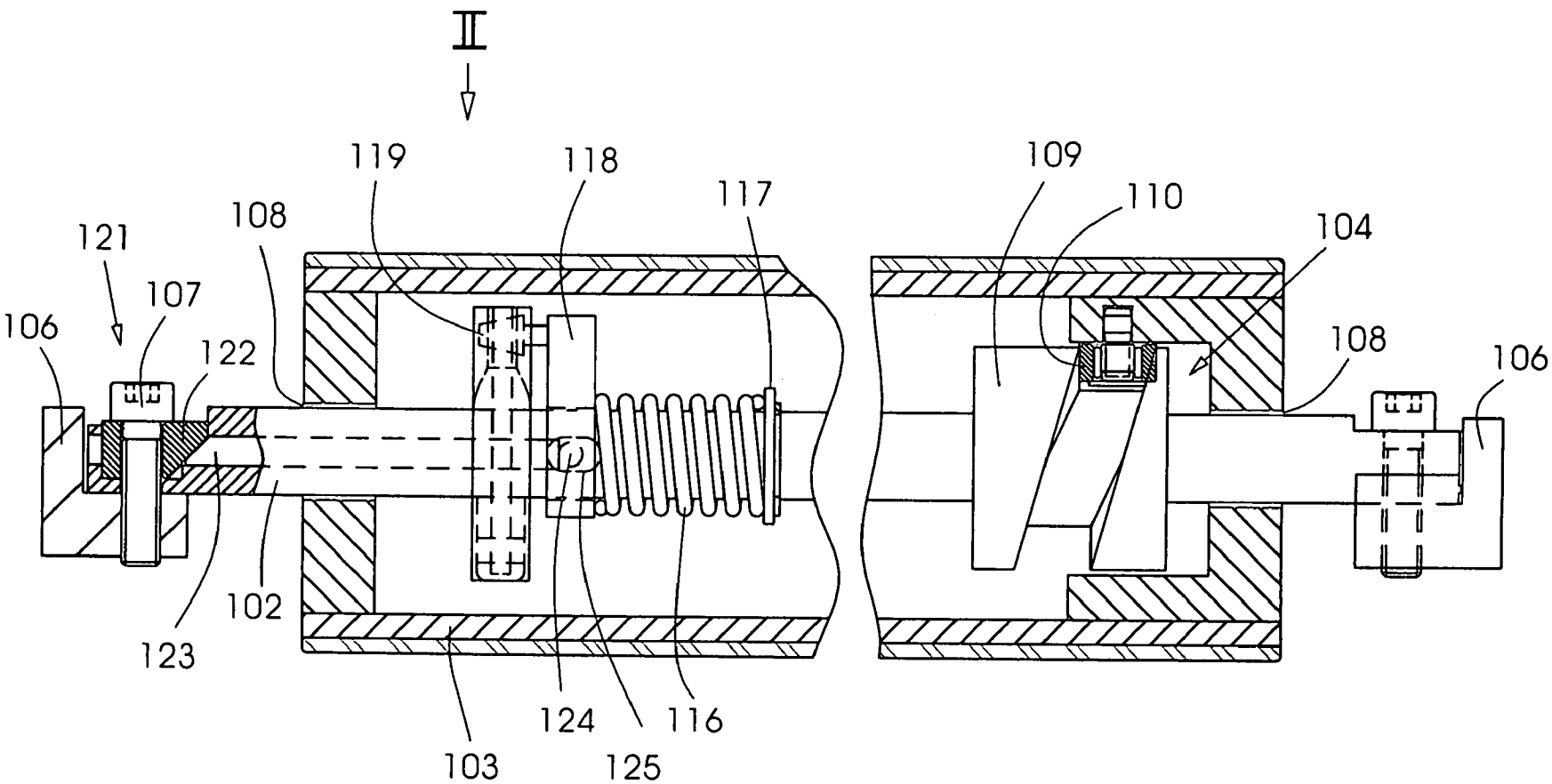
FIG. 1 is a section through an oscillating roll, illustrated with the roll barrel cut open, comprising a locking brake and an automatic safeguard.
Figure 3:
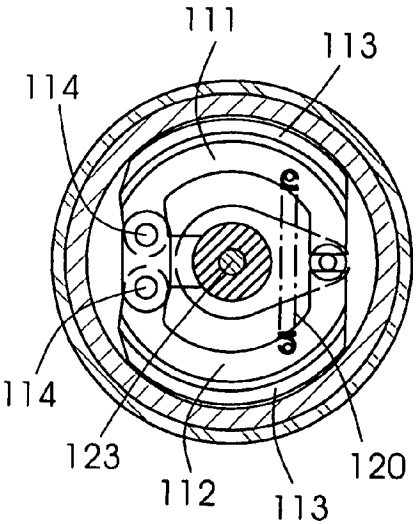
FIG. 3 is a cross-section of the assembly taken along the section line III—III in FIG. 2.
Figure 2:
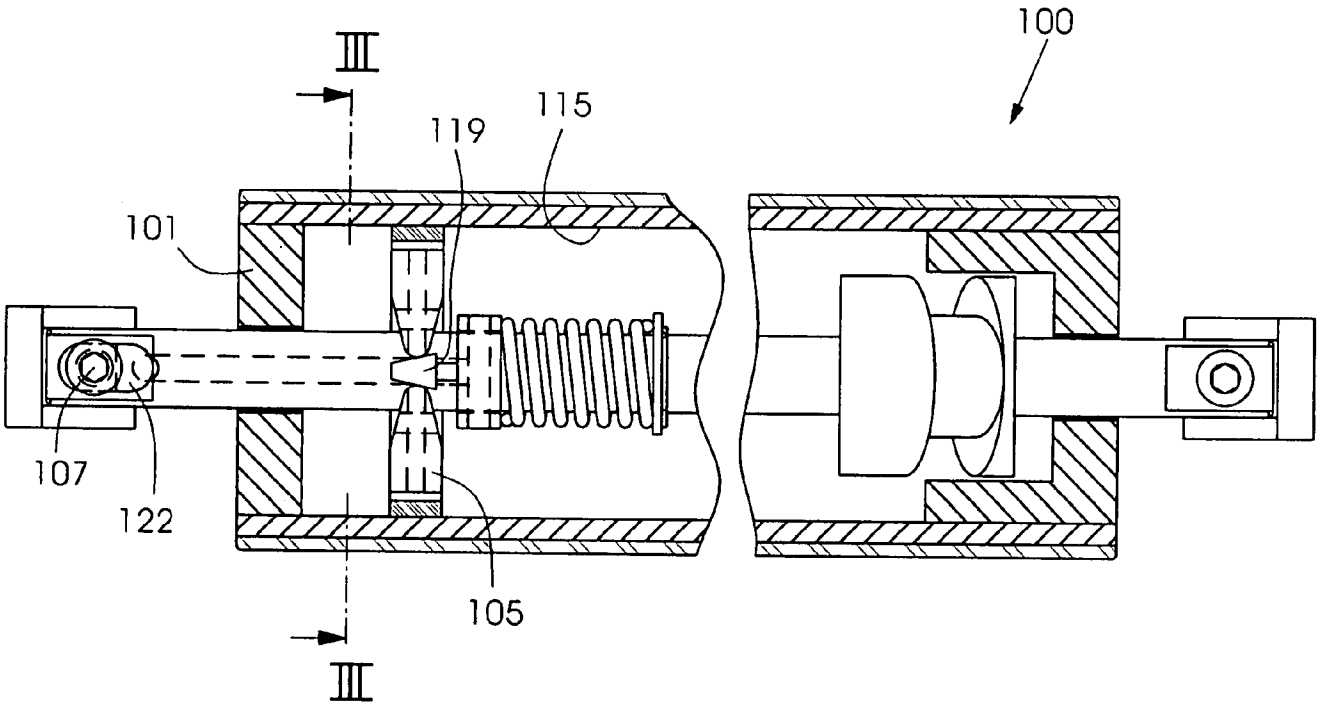
FIG. 2 is an illustration of the oscillating roll viewed in the direction of the arrow II in FIG. 1, and also with the roll barrel shown in section.

Referring now to the figures of the drawing in detail and first, particularly, to FIGS. 1–3 thereof, there is shown a portion of a machine 100 for processing sheet or web printing material. The exemplary machine 100 is a rotary printing press, that is to say a press in which the printing form is located on a printing form cylinder and the printing material is carried by an impression cylinder which, together with the printing form cylinder, belongs to one and the same printing unit. The printing unit also includes an inking mechanism used for inking the printing form and, if the printing unit is an offset printing unit, a blanket cylinder disposed between the printing form cylinder and the impression cylinder, and also a damping mechanism used for damping the printing form. The detail illustrated in various views shows an oscillating or distributor roll 101, also referred to as a vibrator roller 101, which may be a constituent part of the inking unit or the damping unit and is preferably a roll different from the applicator roll that rolls on the printing form.

The distributor roll 101 comprises a roll shaft 102, a roll barrel 103, an oscillating mechanism 104, and a fixing device 105. In a state in which the distributor roll 101 is installed in the machine 100, the roll shaft 102 is mounted with its two shaft ends each secured against rotation in a roll lock 106 functioning as a quick-acting closure. Each of the roll locks 106 comprises a substantially L-profiled, half-shell-like support to carry the respective shaft end and further comprises a screw 107 with a screw head to secure the position of the distributor roll 101. The screw 107 is pushed transversely through the corresponding shaft end and screwed into the support. The supports are fixed to a machine frame or roll frame. The roll barrel 103 is a tube closed at both its tube ends apart from through holes for the roll shaft 102 and is thus substantially hollow-cylindrical. In addition, the roll barrel 103 is mounted on the roll shaft 102 by means of sliding bushes 108 or similar rotary and thrust joints both such that it can rotate about the roll shaft 102 and such that it can be displaced along the latter.

The oscillating mechanism 104 is disposed in the hollow interior of the roll barrel 103 and is used to translate the rotational movement of the roll barrel 103 into the translational to and fro movement of the roll barrel 103. The rotation of the roll barrel 103 is not driven by a gear mechanism nor by a form fit or a form lock but, instead, exclusively frictionally or exclusively by way of circumferential surface or roll friction of a drive roll rolling on the roll barrel 103. The drive roll, adjacent to the distributor roll 101, can be an inking unit roll belonging to the inking unit or a damping unit roll belonging to the damping unit, and the distributor roll 101 can be in rolling contact only with this drive roll and otherwise with no other roll and no cylinder. The oscillating mechanism 104 comprises a cam 109, which is seated on the roll shaft 102 so as to be secure against rotation and thrust, and a cam follower element 110, which is fixed to the roll barrel 103 and, together with the roll barrel 103, rotates about the cam 109 when the machine 100 is operating. The shape of the cam 109 is a so-called grooved cam cylinder with a cam groove that runs annularly and in which the cam follower element 110 engages. The cam track which forces the cam follower element 110 to follow the cam 109 is set obliquely relative to the roll shaft 102, so that the result is the axial linear oscillation of the roll barrel 103 as the output drive movement of the oscillating mechanism 104. In accordance with its function, the cam 109 is therefore what is known as an axial cam. The cam follower element 110 is formed as a cam roller with an axis of rotation oriented substantially radially relative to the distributor roll 101.

The fixing device 105 is constructed as a so-called locking brake and comprises two brake shoes 111, 112 each having a brake lining 113. The shoes 111 and 112 are each mounted such that they can pivot about a joint 114. The substantially bow-shaped brake shoes 111, 112 can be pressed with their convex brake linings 113 against the concavely rounded inner surface 115 of the roll barrel 103 by a brake spring 116, so that the roll barrel 103 and the brake shoes 111, 112 together form a type of drum brake. The joints 114 are arranged so as to be offset eccentrically relative to each other and relative to the roll shaft 102 and, in a departure from the embodiment shown, although they could be arranged eccentrically relative to the roll shaft 102, could be arranged centrally or coaxially relative to each other.

The inner surface 115 and the respective brake lining 113 form interacting holding contact surfaces, one of which (here the brake lining 113) consists of a soft elastic but nevertheless wear-resistant material, such as of polyurethane or another suitable elastomer, and the other (here the inner surface 115) of which is provided with a macro-roughness or a surface structure, such as granularity or grooving. This formation of the holding contact surfaces results in the elevated engaging elements, for example the grains of the granularity, of one holding contact surface pressing relatively deeply into the soft elastic material of the other holding contact surface, so that, between these engaging elements on the one hand and the soft elastic material or the depressions pressed into the latter, on the other hand, there is a certain form fit as soon as the brake shoe 113 is pressed against the inner surface 115 by the brake spring 116. Consequently, when the distributor roll 101 is dismantled and removed from the machine 100, and, as a result, the fixing device 105 is activated or closed by means of an interaction of the holding contact surfaces whose active principle lies in the transition region between a form fit (form lock, i.e., blocking action) and frictional fit (force fit, i.e., inhibiting action) or represents a combination of a form lock and frictional fit, the roll barrel 103 is secured against undesired slippage of the roll barrel 103 along the roll shaft 102. Each of the holding contact surfaces is therefore to a certain extent both a blocking surface and an inhibiting surface. Since the form fit between the holding contact surfaces resulting on account of the elasticity of the material of the one holding contact surface during its elastic deformation can be produced in every possible axial position of the roll barrel 103 relative to the axially fixed fixing device 105 or brake shoe 112 as a result of the automatic activation, further explained later, of the fixing device 105, the principle described here of the interaction between the holding contact surfaces can also be designated "continuous latching." The depressions (the impressions) only formed in the soft elastic material by the engagement elements under the loading of the soft elastic material disappear substantially completely again following the deactivation of the fixing device 105 and the associated removal of said loading. It goes without saying that a mutually interchanged formation of the holding contact surfaces (brake shoe 113 with the macro-roughness or surface structure forming the elevated engagement elements; inner surface 115 of soft elastic material with "reversible depressions") would also be practicable.

The fixing or brake spring 116 is a helical compression spring and is pushed onto the roll shaft 102. The brake spring 116 is fixed to the roll shaft 102 by the brake spring 116 being supported on the roll shaft 102 by its one spring end via a securing ring 117 engaging in the roll shaft 102 and being supported by its other spring end on a slider 118, so that the brake spring 116 is kept permanently under bias between its two supporting points (securing ring 117 or roll shaft 102; slider 118). The brake spring 116 is under a greater prestress when the distributor roll 101 is installed in the machine 100 and when the fixing device 105 is positively deactivated or opened during the installation than when the distributor roll 101 is removed from the machine 100 and the fixing device 105 is positively activated during this removal. However, the somewhat lower prestress on the brake spring 116 which is present when the distributor roll 101 is dismantled is still high enough to keep the fixing device 105 so firmly closed or to maintain such an intense pressure between the holding contact surfaces (brake lining 113, inner surface 115) that secure fixing of the axial position of the roll barrel 113 relative to the roll shaft 102, in each case present when the distributor roll 101 is removed, is ensured even under very contrary conditions, such as a vertical shaft position of the distributor roll 101. The slider 118 is seated on the roll shaft 102 such that it can be displaced along the latter and is provided with a wedge 119 in the form of a cone. The wedge surface of the wedge 119, extending around the wedge 119, or its generatrix, rises at a shallow angle relative to a parallel to the shaft axis 102 in the direction opposite to the active direction of the spring force of the brake spring 117. The wedge 119 forces the brake shoes 111, 112 apart and each of the brake shoes 111, 112 against the inner surface 115 when the fixing device 105 is activated. In this case, the wedge 119 converts the spring force of the brake spring 116, which attempts to displace the slider 118 and the wedge 119 arranged on the latter toward the brake shoes 112, into the holding force causing the pressure between the holding contact surfaces, said holding force being exerted by the fixing device 105 and its brake shoes 111, 112 on the roll barrel 103 in order to secure the latter axially.

At least one return spring 120, which is formed as a helical tension spring and which is fixed by its one spring end to one brake shoe 111 and by its other spring end to the other brake shoe 112 by means of eyelets integrally molded at the ends of the return spring 120, attempts to pull the brake shoes 111, 112 toward each other. When the fixing device 105 is activated, the return spring 120 is under a greater prestress than in the deactivated state of the fixing device 105. The brake spring 116 and the return spring 120 are matched to each other in terms of their spring forces and spring characteristics in such a way that, when the fixing device 105 is activated, the brake spring 116 is able to spread the brake shoes 111, 112 apart counter to the resistance of the return spring 120. It will be readily understood that a modification of the fixing device 105 would also be practicable according to which modification one of the brake shoes 111, 112 is left out and the return spring 120 pulling the remaining, single brake shoe against the wedge 119 is suspended by its one spring end on the single brake shoe and by its other spring end on the roll shaft 102.

For the purpose of the activation of the fixing device 105 carried out automatically when the distributor roll 101 is released from the roll locks 106, and the deactivation of the fixing device 105 likewise carried out automatically when the distributor roll 101 is laid in the roll locks 106, an automatic mechanism in the form of a securing device 121 is provided, to which the screw 107, a wedge-like switching element 122 and a push rod 123 belong. The push rod 123 is plugged into the roll shaft 102 such that it can be displaced along the latter. For this purpose, the roll shaft 102 is provided with a preferably central longitudinal bore that guides the push rod 123 and is thus, at least to some extent, formed as a hollow shaft. A beveled end of the push rod 123, together with the switching element 122, forms a wedge mechanism and the opposite end of the rod is connected to the slider 118 via a transverse pin 124, which projects through a slot 125 in the roll shaft 102, opening into the longitudinal bore, and is firmly seated with one pin end in the push rod 123 and with its other pin end in the slider 118. The switching element 122 is seated in a slot which intersects the longitudinal bore guiding the push rod 123, is introduced into the roll shaft 102 close to its shaft end and guides the switching element 122 when the latter is actuated. The switching element 122 or a through hole introduced into the latter is penetrated by the screw 107, which is supported with its screw head on the switching element 122.

The function of the securing device 121 is as follows: when the operator wishes to remove the distributor roll 101 from the machine 100, for example for the purpose of its cleaning or other maintenance, he first has to unscrew the screw 107 from the appropriate roll lock 106, the switching element 122 being relieved of the pressure of the screw head. As a result, the brake spring 116 is able to displace the slider, including its wedge 119, together with the transverse pin 124 moving along the slot 125 in the process and the push rod 123, in the direction of the securing device 121, that is to say to the left with respect to FIG. 1, and, at the same time, via the wedge mechanism and the mutually paired wedge surfaces of the beveled shaft end and of the switching element 122, to force the latter a little out of the shaft axis 102 and also, via the wedge 119, to press the brake shoes 111, 112 against the inner surface 115. If the distributor roll 101 is subsequently brought by the operator into an axial alignment which differs from the horizontal, for example substantially vertical axial alignment, and, for example, is leaned against a room wall in this way, the oscillating mechanism 104 cannot suffer any damage as a result of this handling of the distributor roll 101, since the fixing device 105 has already been activated positively at this time by the automatic mechanism described.

For instance, the roll barrel 103 can no longer slip downward on the shaft axle 102 under the action of its inherent weight (the mass of the roll barrel 103 depends on the maximum printing material format for which the machine 100 is designed and can, for example, be more than 50 kg and, in the event that the machine 100 is a double-width web-fed rotary press, can be particularly high!) as a result of the alignment of the distributor roll 101 until the roll barrel 103 has reached its lower dead-point position and the falling movement of the roll barrel 103 would be ended abruptly with one part of the oscillating mechanism 104 striking another, there being the risk that the oscillating mechanism 104 would be damaged. This risk is averted absolutely reliably by the fixing device 105.

For instance, by means of the fixing device 105, damage to the cam follower element 110 (distortion or breakage of the roller pin of the cam follower element 110) caused by an impact will also be prevented, it being possible for said impact to be caused by the operator, when removing the distributor roll 101 from the machine 100, keeping the distributor roll 101 in the horizontal axial orientation but striking one end of the roll shaft 102 on a lateral frame wall of the machine frame or the roll framing through inattention. In this connection, it is important for the appreciation of the handling advantages achieved by the fixing device 105 to note that the oscillating mechanism 104 could also be constructed in practice in a departure from its comparatively robust design illustrated in FIGS. 1 and 2 and in accordance with another design which is finer and therefore more susceptible to impacts.

When the operator inserts the distributor roll 101 into the machine 100 again following its maintenance, he first lays the roll shaft 102 in the roll locks 106. Only then, when impacts exerted on the roll shaft 102 are no longer to be feared and the distributor roll 101 is held in the risk-free horizontal position by the roll locks 106, is the deactivation of the fixing device 105 and the action of releasing of the brake shoes 112 carried out by the automatic mechanism (securing device 121), the following taking place in detail: as the screw 107 is screwed into the roll lock 106 forming one part of the securing device 121, the pressure exerted by the screw head of the screw 107 on the switching element 122 increases gradually and, as a result of this, through the wedge action of the switching element 122, the push rod 123 is forced back into the distributor roll 101 and its roll shaft 102. This is done while overcoming the spring force of the brake spring 116 which, in this case, is compressed less severely. At the same time, the slider 118 is displaced back into its original position (to the right with respect to FIG. 1), so that the wedge 119 consequently gives the brake shoe 112 the necessary clearance to be able to be lifted off the inner surface 115 again by the return spring 120. As soon as the screw 107 has been tightened firmly, the axial fixing of the roll barrel 103 is cancelled and the latter can move to and fro along the roll shaft 102 again when the machine is running.

Figure 5:
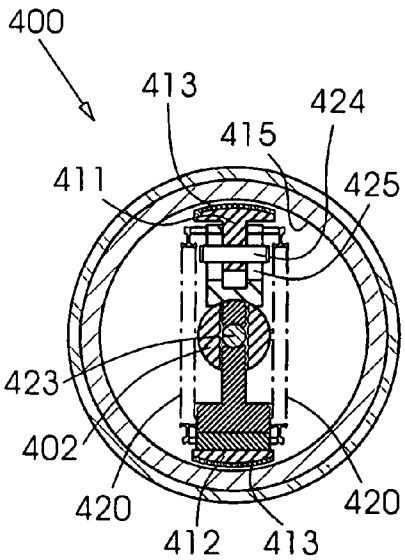
FIG. 5 is a section taken through the assembly along the section line V—V in FIG. 4.
Figure 4:
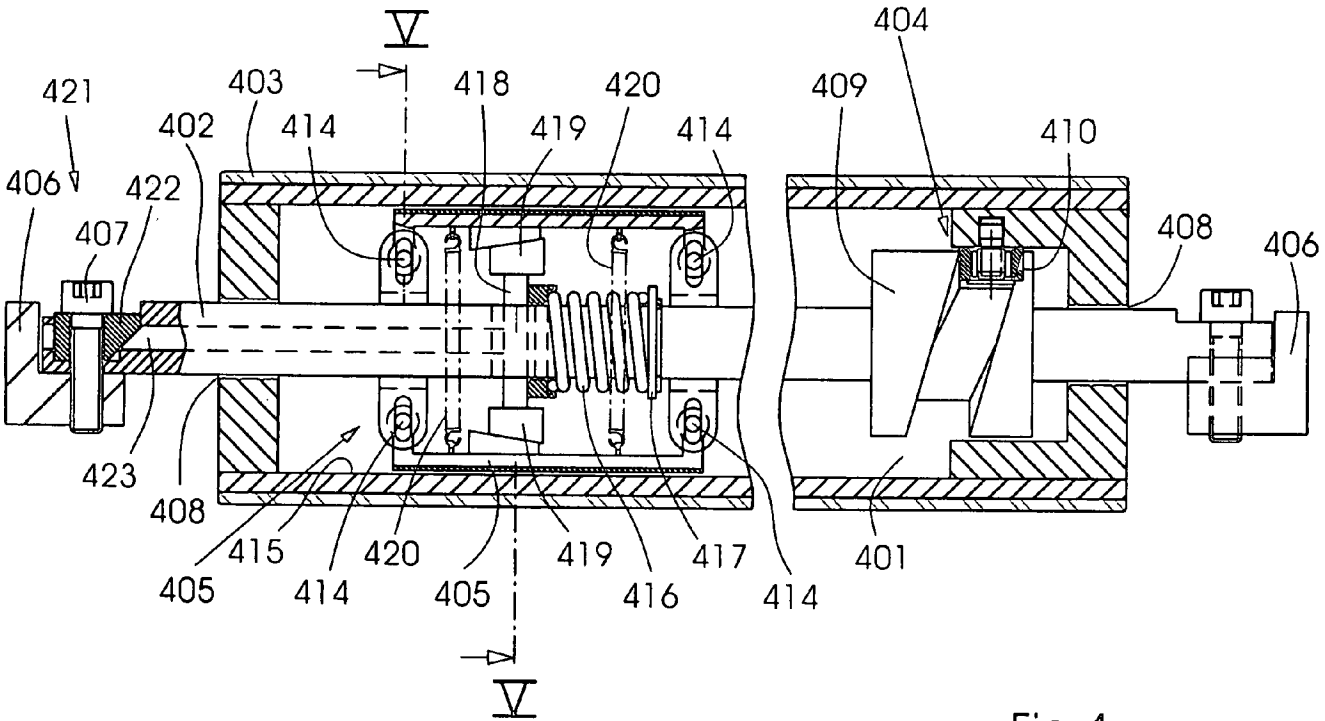
FIG. 4 is a section of an alternative embodiment of the oscillating roll, with a locking brake changed with respect to FIG. 1.

FIGS. 4 and 5 illustrate a second exemplary embodiment of the invention, which differs from the first embodiment illustrated in FIGS. 1 to 3 only with respect to a few elements. The elements provided with the designations 400 to 413; 415 to 418; 420 to 423 in FIGS. 4 and 5 correspond fully to the elements provided with the designations 100 to 113; 115 to 118; 120 to 123 in FIGS. 1 to 3, so that the description already given with respect to these elements from FIGS. 1 to 3 is also valid in the transferred sense for the aforementioned elements from FIGS. 4 and 5 and these elements do not need to be described specifically once more. (The numerical value of the designation of the respective element from FIGS. 4 and 5 is increased by 300 as compared with the numerical value of the element identical therewith from FIG. 1 to 3; for example, one and the same screw in FIG. 1 is designated by the designation 107 and in FIG. 4 by the designation 407).

Special features and differences possessed by the second exemplary embodiment as compared with the first will be explained in detail below:

The brake shoes 411, 412 are linear and are mounted such that they can be displaced in the substantially radial direction with respect to the oscillating or distributor roll 401 against the inner surface 415 of the latter. For this purpose, each of the brake shoes 411, 412 is mounted at both its shoe ends by means of a joint 415 formed as a thrust joint (linear guide). The joints 415 in each case comprise a transverse pin 424 which functions as a slotted guide block and is firmly seated in the respective brake shoe. In addition, the joints 415 comprise respectively mutually aligned slots 425, in which the transverse pin 424 slides as the brake shoes 411, 412 are displaced. The two slots 425 of each joint 415 are introduced into forked arms of a double fork which functions as a slotted guide and which is firmly seated on the roll shaft 402.

The slider 418 is equipped with two diametrically arranged wedges 419, each of which actuates another of the brake shoes 411, 412 via a mating wedge arranged on the inside of this brake shoe in order to force the brake shoes 411, 412 apart when the fixing device 405 is activated automatically during the roll removal via the securing device 421 in the manner already described in connection with the first exemplary embodiment (FIGS. 1 to 3). The slider 418 is seated in a slot which penetrates the roll shaft 402 transversely and extends longitudinally along the roll shaft 402 and can be displaced in the slot along the roll shaft 402. The brake shoes 411, 412 are assigned a plurality of return springs 420 which pull the brake shoes 411, 412 together and set them away from the inner surface 415 during the deactivation of the fixing device 405 that is carried out automatically during the roll installation.

Figure 6A:
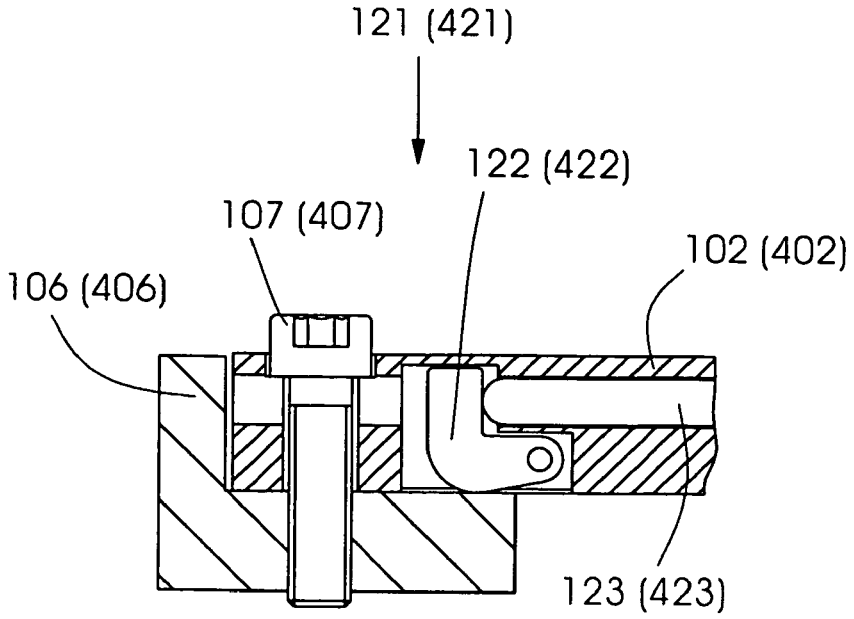
FIGS. 6A, 6B, and 7 are partial sectional views of various possible modifications of the automatic safeguard.
Figure 6B:
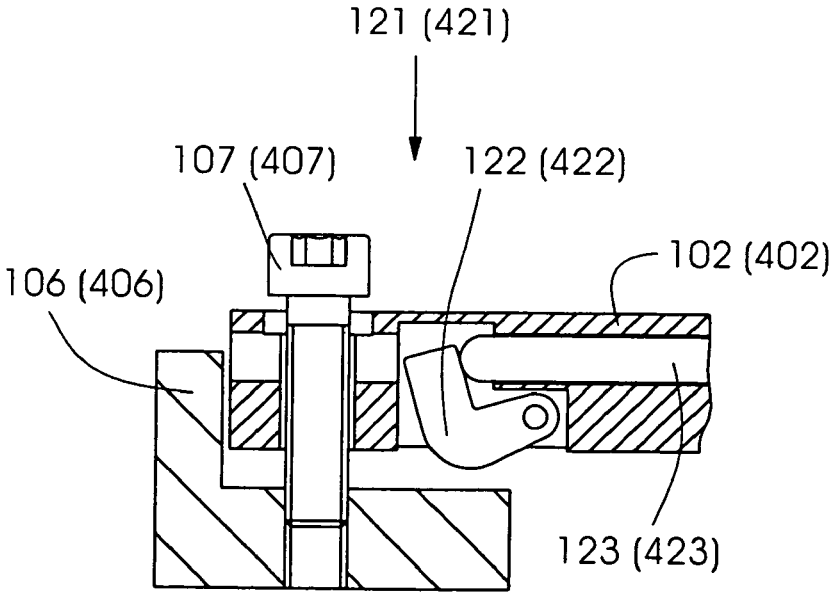
Figure 7:
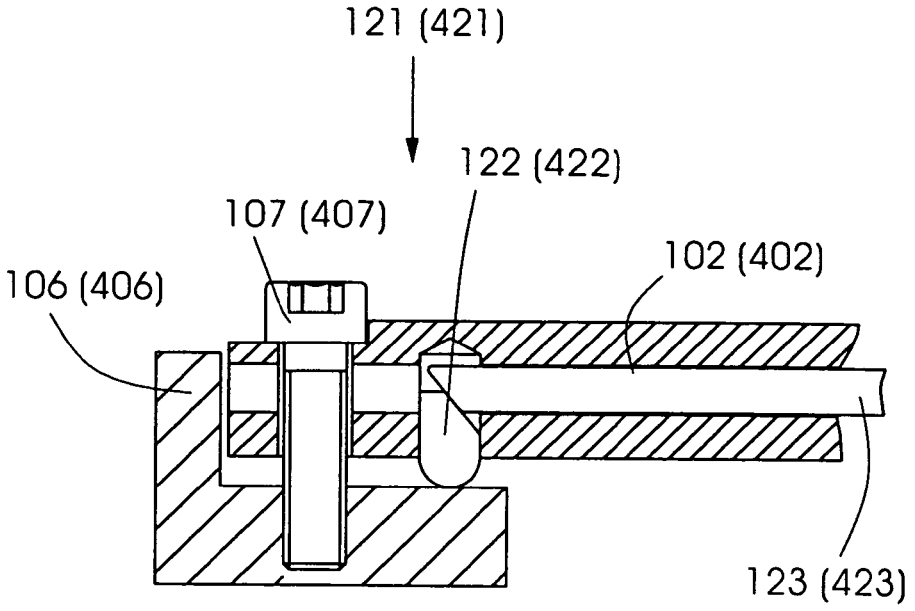
Figure 8:
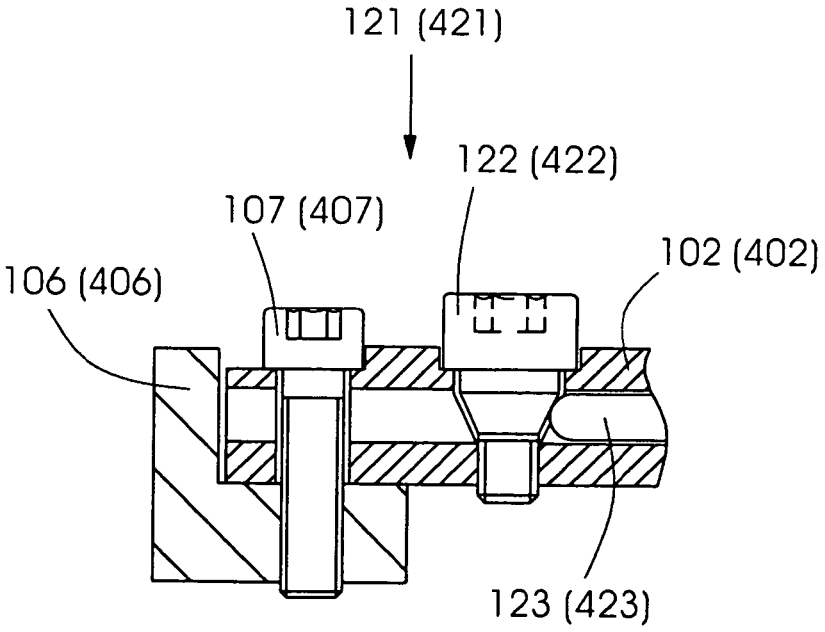
FIG. 8 is a sectional view of a securing device used instead of the automatic safeguard with a manual operating capability.

FIGS. 6A and 6B illustrate a first modification, FIG. 7 illustrates a second modification, and FIG. 8 illustrates a third modification of the securing device 121. The designations in parentheses in FIGS. 6A to 8 illustrate the fact that the securing device 421 can also be modified in such a way. The modifications explained in detail below are therefore valid for all the exemplary embodiments explained previously.

According to the modification illustrated in FIGS. 6A and 6B, the switching element 122 is formed as a switching lever. The switching lever is pivotably mounted in the slot introduced into the roll shaft 102 and has a knee which, when the roll shaft 102 is laid in the roll lock 106, makes contact with the latter so that, as a result, the switching lever shaped as an angled lever is forced into the roll shaft 102 by the roll lock 106 and, with its free and, pushes the push rod into the distributor roll and deactivates the fixing device in this way. The position of the switching lever when the roll shaft 102 is laid in the roll lock 106 and the fixing device is deactivated as a result is illustrated in FIG. 6A. As a result of lifting the roll shaft 102 from the roll lock 106, the contact between the roll lock 106 and the switching lever facing the roll lock 106 is lost, so that the switching lever is consequently freed of the force loading it against the brake spring (for example the inherent weight of the distributor roll) and the brake spring can then force the switching lever 122 out of the roll shaft 102 via the push rod 123 and can activate the fixing device in the process. The position of the switching lever when the fixing device is activated and when the roll shaft 102 is lifted from the roll lock 106 is illustrated in FIG. 6B.

FIG. 7 illustrates the fact that the switching element 122 or 422 can also be formed as a switching plunger whose single functional difference from the switching lever illustrated in FIGS. 6A and 6B is that the switching plunger is not mounted such that it can pivot but, instead, can be displaced in the transverse direction into the roll shaft 102 and out of the latter. The switching plunger has a wedge face at the end which, together with a wedge face at the end of the push rod 123, forms a wedge mechanism.

The sole substantial difference which is in principle present between the switching plunger in FIG. 7 and the wedge-like switching element 122 in FIG. 1 is as follows: the switching element 122 in FIG. 1 is actuated by the screw head when the screw 107 is tightened and is mounted on the half shaft laid on the roll lock 106 (the upper half shaft with respect to FIG. 1) of the roll shaft 102 such that it can be displaced out of the latter. As opposed to this, the switching plunger in FIG. 7 is not actuated by the screw head of the screw 107 but instead by the roll lock 106, and the switching plunger is mounted on the half shaft facing the roll lock 106 (the lower half shaft with respect to FIG. 7) of the roll shaft 102 such that it can be displaced out of the latter. One advantage of the switching elements 122 illustrated in FIGS. 6A to 7 is that these can also be used for roll locks 106 which have no screw 107 for screwing the roll shaft 102 on.

For such a roll lock without a fixing screw 107, the switching element 122 of the embodiment shown in FIG. 8, formed as a switching screw, would also be suitable. As a result of screwing the switching screw into the roll shaft 102, the push rod 102 is forced back into the distributor roll via a conical face integrally molded on the switching screw, in order to deactivate the fixing device or in order to release the brake shoes from the roll inner surface. If the operator wishes to secure the axial position of the roll barrel on the roll shaft 102 and, for this purpose, to activate the fixing device, then he simply needs to screw the switching screw a little out of the roll shaft 102, so that the push rod 123 is provided by the switching screw with clearance for a displacement of the push rod 123 out of the distributor roll (to the left with respect to FIG. 8).

This application claims the priority, under 35 U.S.C. § 119, of German patent application No. 103 13 720.3, filed Mar. 27, 2003; the entire disclosure of the prior application is herewith incorporated by reference.

We claim:

1. In a printing material processing machine, an oscillating roll assembly, comprising:

an oscillating roll having a roll shaft, a roll barrel rotatably and axially displaceably mounted on said roll shaft, and an oscillating mechanism for moving said roll barrel to and fro along said roll shaft;

at least one roll lock for mounting said oscillating roll in the machine; and a fixing device configured to secure said roll barrel against displacement along said roll shaft in a dismantled state of said oscillating roll, in which said oscillating roll is released from said roll lock, and to permit axial displacement of said roll barrel in an installed state of said oscillating roll, in which said oscillating roll is mounted in said roll lock, said fixing device being mechanically coupled to said roll lock such that, upon dismantling of said oscillating roll, said fixing device is automatically activated to fix said roll barrel.

2. The assembly according to claim 1, wherein said fixing device is mechanically coupled to said roll lock such that, upon mounting of said oscillating roll, said fixing device is automatically deactivated and said roll barrel is released.

3. The assembly according to claim 1, wherein said fixing device is a drum brake.

4. The assembly according to claim 1, wherein said fixing device is configured for latching and activation in any desired axial position of said roll barrel relative to said roll shaft.

5. The assembly according to claim 1, wherein said fixing device is configured to be continuously operative in all operating stages of said oscillating roller.

6. The assembly according to claim 1, wherein said roll barrel is configured to be driven in rotation exclusively via circumferential surface friction.

7. The assembly according to claim 1, wherein said oscillating mechanism is at least partly integrated into said roll barrel.

8. The assembly according to claim 1, wherein said fixing device is at least partly integrated into said roll barrel.

9. The assembly according to claim 1, which comprises a switching element for selectively activating and deactivating said fixing device disposed on said roll shaft, said switching element being movably mounted for activation by said roll lock.

10. The assembly according to claim 1, wherein said oscillating roll is not an applicator roll.

11. The assembly according to claim 1, wherein the printing material processing machine is a press and said oscillating roll is a damping solution distributor roll or an ink distributor roll.

12. In a printing material processing machine, an oscillating roll assembly, comprising:

an oscillating roll having a roll shaft, a roll barrel rotatably and axially displaceably mounted on said roll shaft, and an oscillating mechanism for moving said roll barrel to and fro along said roll shaft;

at least one roll lock for mounting said oscillating roll in the machine; and a fixing device configured to secure said roll barrel against displacement along said roll shaft in a dismantled state of said oscillating roll, in which said oscillating roll is released from said roll lock, and to permit axial displacement of said roll barrel in an installed state of said oscillating roll, in which said oscillating roll is mounted in said roll lock, said fixing device being mechanically coupled to said roll lock such that, upon mounting of said oscillating roll, said fixing device is automatically deactivated and said roll barrel is released.

13. The assembly according to claim 12, wherein said fixing device is a drum brake.

14. In a printing material processing machine, an oscillating roll assembly, comprising:

an oscillating roll having a roll shaft, a roll barrel rotatably and axially displaceably mounted on said roll shaft, and an oscillating mechanism for moving said roll barrel to and fro along said roll shaft;

at least one roll lock for mounting said oscillating roll in the machine;

a fixing device configured to secure said roll barrel against displacement along said roll shaft in a dismantled state of said oscillating roll, in which said oscillating roll is released from said roll lock, and to permit axial displacement of said roll barrel in an installed state of said oscillating roll, in which said oscillating roll is mounted in said roll lock; and a switching element for selectively activating and deactivating said fixing device disposed on said roll shaft, said switching element being movably mounted for activation by said roll lock.

15. The assembly according to claim 14, wherein said fixing device is a drum brake.

* * * * *